US005234282A

United States Patent [19]

Osborn

[11] Patent Number: 5,234,282

[45] Date of Patent: Aug. 10, 1993

[54] GRAVITY DROP HAMMER APPARATUS FOR A SKID LOADER

[76] Inventor: John H. Osborn, 1300 Bertram Rd., SE., Cedar Rapids, Iowa 52403

[21] Appl. No.: 933,715

[22] Filed: Aug. 24, 1992

[51] Int. Cl.[5] ..... E01C 23/12

[52] U.S. Cl. ..... 404/90; 37/403; 299/37

[58] Field of Search ..... 404/90; 299/36, 37, 299/69, 94; 37/117.5, DIG. 12

[56] References Cited

U.S. PATENT DOCUMENTS

| | | | |
|---|---|---|---|
| 2,529,892 | 11/1950 | Adams . | |
| 2,658,540 | 11/1953 | Sobaski . | |
| 3,075,754 | 1/1963 | Bies | 299/37 |
| 3,133,730 | 5/1964 | Cornett | 299/37 X |
| 3,805,897 | 4/1974 | Cobb et al. | 299/37 X |
| 4,457,645 | 7/1984 | Klochko | 404/90 |
| 4,884,641 | 12/1989 | Kendall | 173/94 |
| 4,944,628 | 7/1990 | Huldén | 37/117.5 X |
| 4,958,848 | 9/1990 | Nash | 280/509 |

OTHER PUBLICATIONS

Bobcat Brochure, "Bobcat Multipurpose Attachments", undated.

Bobcat Brochure, "Bobcat 1250 Hydraulic Breaker" undated.

Bobcat Brochure, "Bobcat 2500 Hydraulic Breaker", undated.

Bobcat Brochure, "Bobcat 3500 Hydraulic Breaker", undated.

Bobcat Brochure, "Bobcat 5500 Hydraulic Breaker", undated.

Bobcat Brochure, p. 17, undated.

Impact Technologies Inc. Brochure, "Hard Hitting Breakers" undated.

*Primary Examiner*—David J. Bagnell

*Attorney, Agent, or Firm*—Brian J. Laurenzo; Kent A. Herink

[57] ABSTRACT

A gravity drop hammer apparatus for mounting on the bucket attachment mechanism of a skid loader, in which at least a distal portion of the hammer apparatus is capable of dropping, under forces of gravity, from a raised position toward an impact position upon release by an operator of the skid loader, the hammer apparatus allowing for variable impact at distal locations from the skid loader. The gravity drop hammer apparatus comprises a hammer member, a mounting plate member which is pivotally attached to the hammer member for attaching the hammer member to the bucket attachment mechanism of the skid loader, and a releasable latching assembly for latching the hammer member to the mounting plate member prior to pivotally raising the hammer member to its raised position. Upon release of the releasable latching assembly, the hammer member is allowed to fall, under the forces of gravity, from the raised position to the impact position.

7 Claims, 3 Drawing Sheets 36
34
16
32
26
18
10
28
90
14
24
12
38
84
80
76
86
30
22
20
60
62
44

14
90
16
18
32
10
78
66
24
38
80
64
28
34
62
26
36
12
84
76
44
86
30
22
20

14
90
16
18
32
10
78
66
24
38
80
64
28
34
12
44
26
36
62
84
76
86
30
22
20

10
14
16
18
20
22
24
26
28
30
32
34
36
38
40
42
43
44
45
46
48
50
52
54
58
60
62
64
66
68
70
72
74
76
78
80
82
84
86
88
90

GRAVITY DROP HAMMER APPARATUS FOR A SKID LOADER

BACKGROUND OF THE INVENTION

This invention relates to concrete breakers and the like for skid loaders and, more particularly, to a gravity drop hammer apparatus for mounting on bucket attachment means of a skid loader in which at least a distal portion of the hammer apparatus is capable of dropping, under the forces of gravity, from a raised position toward an impact position, upon release by an operator of the skid loader for variable impact at distal locations from the skid loader.

The use of concrete breakers and the like with a variety of construction equipment, including skid loaders, is well known in the prior art. Likewise, gravity drop hammers for breaking concrete and the like are also known. However, concrete breakers for skid loaders are typically comprised of a vibratory weight of a punch or chisel configuration which is powered by auxiliary hydraulics on the skid loader to deliver 500–1300 vibratory blows per minute. Such breakers are complicated machines which are expensive to purchase and maintain. In addition, these breakers can only be used on skid loaders with corresponding attachment features including auxiliary hydraulics. Furthermore, these breakers can be difficult to attach and remove as the hydraulic lines are hard to connect and disconnect when under pressure. Hydraulic oil is often sprayed out of the lines during connection and disconnection.

Accordingly, it is desirable to provide a concrete breaker which is less complicated and expensive than the hydraulic powered vibratory breakers of the prior art and which may be used on all skid loaders, regardless of whether or not the skid loader has auxiliary hydraulics. The difficulties in the prior art concrete breakers and the like are substantially eliminated by the present invention.

SUMMARY OF THE INVENTION

Accordingly, it is an object of the present invention to provide a gravity drop hammer apparatus for a skid loader in which at least a distal portion of the hammer apparatus is capable of dropping, under the forces of gravity, from a raised position toward an impact position, upon release by an operator of the skid loader.

It is another object of the present invention to provide a gravity drop hammer apparatus for a skid loader which can deliver variable impacts at distal locations from the skid loader.

It is still another object of the present invention to provide a gravity drop hammer apparatus for a skid loader which may be mounted to the bucket attachment means of the skid loader.

It is a further object of the present invention to provide a gravity drop hammer apparatus for a skid loader which may be raised by the bucket raising means of the skid loader.

An additional object of the present invention is to provide a gravity drop hammer apparatus for a skid loader which may be used on all skid loaders, regardless of whether the skid loader has auxiliary hydraulics or not.

A further object of the present invention is to provide a gravity drop hammer apparatus for a skid loader which does not require auxiliary hydraulics.

Yet another object of the present invention is to provide a gravity drop hammer apparatus for a skid loader which is less expensive and less complicated than those of the prior art.

By the present invention, it is proposed to overcome the difficulties encountered heretofore. To this end, a gravity drop hammer apparatus for mounting to bucket attachment means of a skid loader is provided in which at least a distal portion of the hammer apparatus is capable of dropping, under the forces of gravity, from a raised position toward an impact position, upon release by an operator of the skid loader for variable impact at distal locations from the skid loader. The gravity drop hammer apparatus comprises a hammer member, hammer support means for operable and pivotal attachment of the hammer member to the bucket attachment means of the skid loader, pivot means operably interposed between the hammer member and the hammer support means for enabling the hammer member to pivot between the raised position and the impact position, and releasable latching means operably interposed between the hammer member and the hammer support means for automatically latching the hammer member to the hammer support means prior to raising the hammer member to a raised position and for maintaining the hammer member in the raised position. Upon release of the releasable latching means by the operator of the skid loader, the hammer member is allowed to drop, under the forces of gravity, from the raised position towards the impact position.

DETAILED DESCRIPTION OF THE INVENTION

Figure 1:
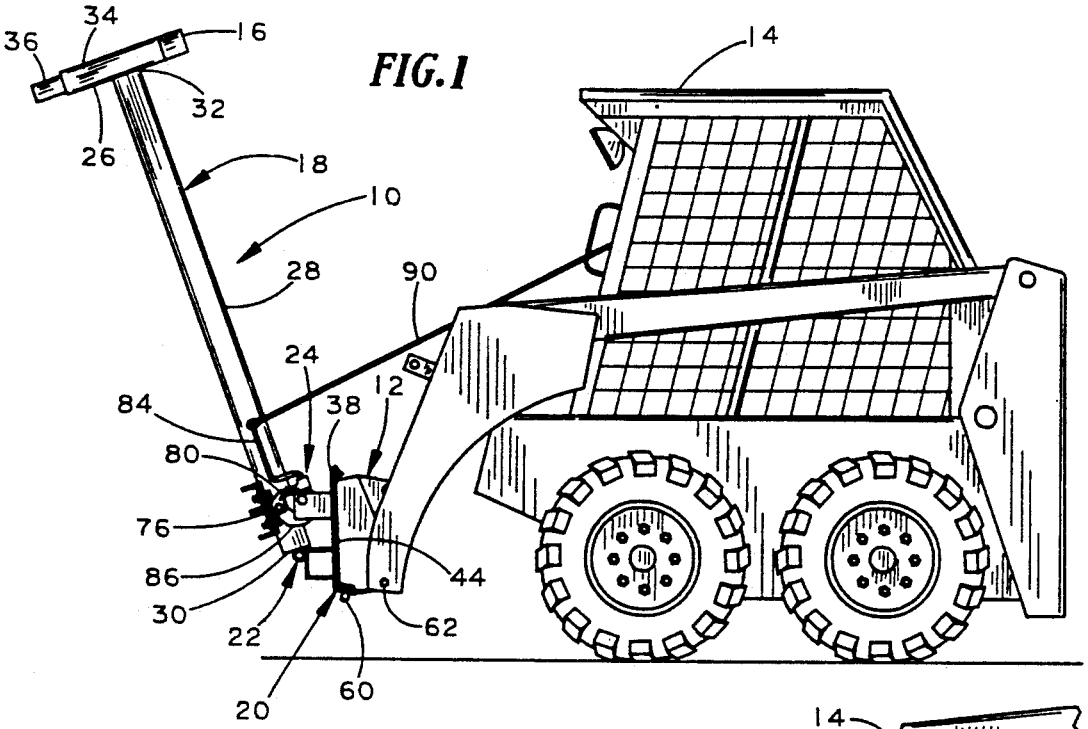
FIG. 1 is an elevational view of a gravity drop hammer apparatus in a latched and raised position and attached to a skid loader in accordance with the present invention.
Figure 7:
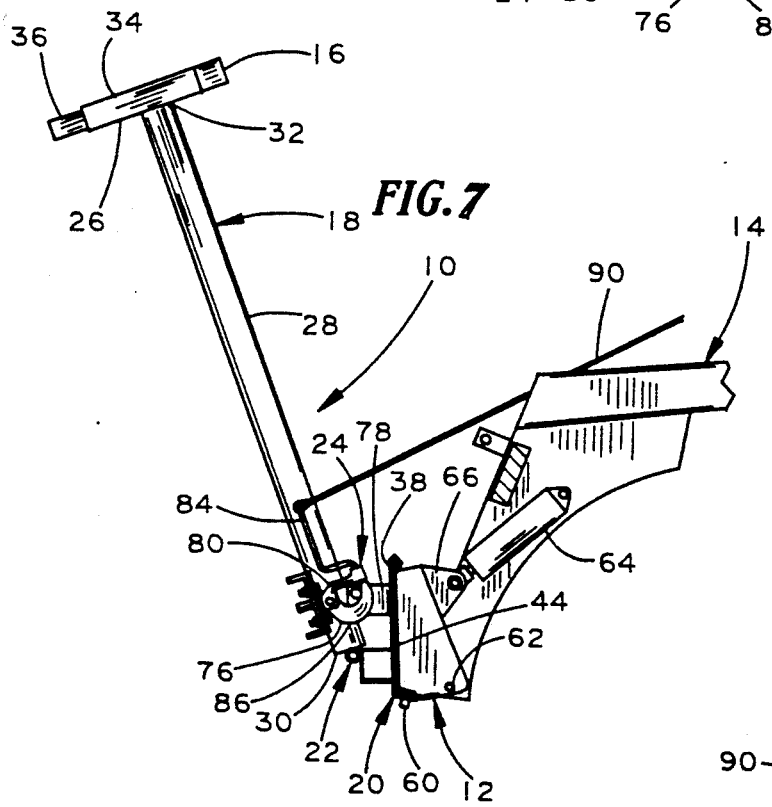
FIG. 7 is an elevational view of the gravity drop hammer apparatus in a raised position.
Figure 8:
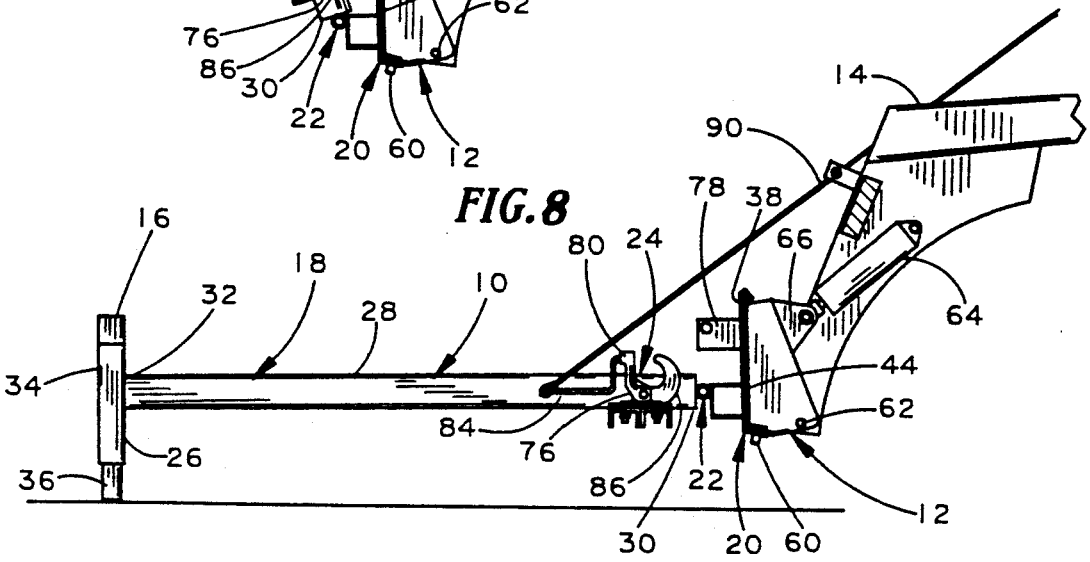
FIG. 8 is an elevational view of the gravity drop hammer apparatus in a released post-impact position.

In the Figures, a gravity drop hammer apparatus is shown generally at 10 for mounting on bucket attachment means 12 of a skid loader 14, in which at least a distal portion 16 of the hammer apparatus 10 is capable of dropping, under forces of gravity, from a raised position, as shown in FIGS. 1 and 7, toward an impact position, as shown in FIG. 8, upon release of said hammer apparatus 10 by an operator of the skid loader 14.

The hammer apparatus 10 may be used for variable impact at distal locations from the skid loader 14.

Figure 4:
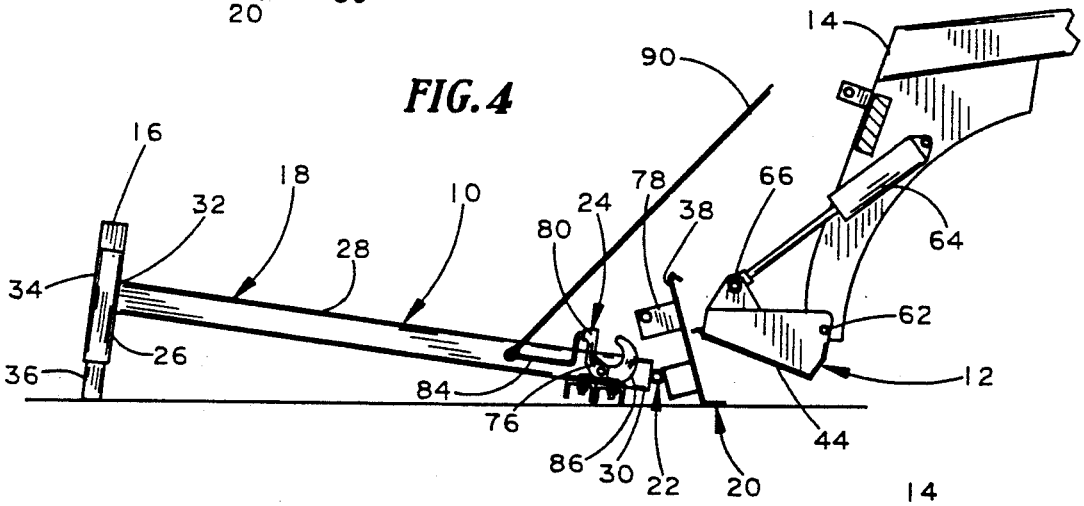
FIG. 4 is an elevational view of the gravity drop hammer apparatus shown in FIG. 1 prior to attachment with the skid loader.
Figures 2, 3:
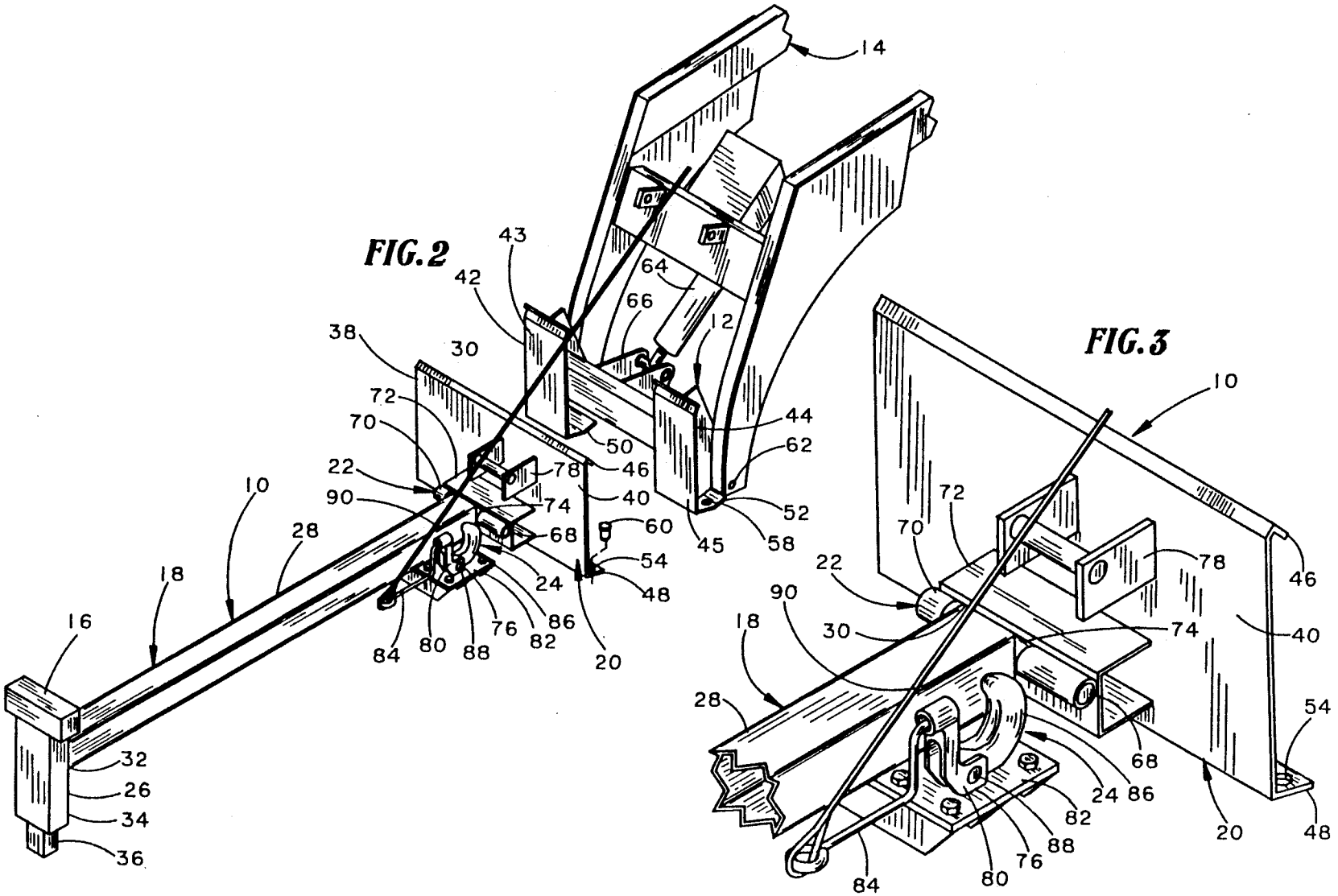
FIG. 2 is a perspective view of the gravity drop hammer apparatus shown in FIG. 1 in an unattached position.
FIG. 3 is a detailed perspective view of the latching assembly of the present invention.

In FIGS. 2–4, the gravity drop hammer apparatus 10 is shown prior to mounting on the bucket attachment means 12 of the skid loader 14. The hammer apparatus 10 is comprised of a hammer member 18 and hammer support means 20, the hammer support means 20 which are attached to the bucket attachment means 12 of the skid loader. The hammer support means 20 are further pivotally attached to the hammer member 18 by pivot means 22 which are located for operation between the hammer member 18 and the hammer support means 20 thereby providing a pivotal connection between the hammer member 18 and the bucket attachment means 12 of the skid loader 14.

The gravity drop hammer apparatus 10 further comprises releasable latching means 24 located for operation between the hammer member 18 and the hammer support means 20 for automatically latching the hammer member 18 to the hammer support means 20 prior to raising the hammer member 18 to a raised position. The releasable latching means 24 additionally maintain the hammer member 18 in the raised position. Upon release of the latching means 24 by an operator of the skid loader 14, the latching means 24 allow the hammer member to drop, under the forces of gravity, from the raised position towards the desired impact position.

In the preferred embodiment, the hammer member 18 has a head portion 26 located at the distal portion 16 of the hammer apparatus 10 and a longitudinally extended arm portion 28, the arm portion 28 which has a first end 30 and a second end 32. The first end 30 of the longitudinally extended arm portion 28 is located proximate the hammer support means 20 and is pivotally attached thereto. The second end 32 of the longitudinally extended arm portion 28 is located proximate and is attached to the head portion 26 of the hammer member 18. The head portion 26 of the hammer member 18 has a main body section 34 attached to the second end 32 of the arm portion 28 of the hammer member 18 and a striking section 36 which is positioned below the main body section 34 to provide the impact from the hammer member 18 when the hammer member 18 is dropped. The cross-section of the striking section 36 is narrower than the cross-section of the main body section 34 to provide a concentrated load at the impact location.

The hammer support means 20 of the preferred embodiment are made up of a mounting plate member 38 which corresponds in size and shape for attachment to the bucket attachment means 12 of the skid loader 14. In FIGS. 2 and 3, the mounting plate member 38 is shown as a rectangular metal base 40 which corresponds in size and shape to two interconnected L-shaped face plates 42 and 44 which are the interfacing portion of the bucket attachment means 12 of the skid loader 14. The mounting plate member 38 includes an overturned lip 46 for overlapping the top of the leg portions 43 and 45 of the interconnected face plates 42 and 44. The mounting plate member 38 further includes bottom flanges 48 (only one shown) for underlapping the foot portions 50 and 52 of the interconnected face pates 42 and 44 respectively. The flanges 48 have apertures 54 (only one shown) and the foot portions 50 and 52 of the interconnected face plates 42 and 44 have apertures 58 (only one shown) which are aligned with the apertures 54 of the bottom flanges 48 of the mounting plate member 38 for insertion of connecting pins 60 (only one shown) when the mounting plate member 38 is attached to the interconnected face plates 42 and 44 of the skid loader 14. It is to be understood that an identical bottom flange 48, aperture 54, and connecting pin 60 are located on the mounting plate member 38 corresponding to foot portion 50 of face plate 42 on the skid loader 14.

Figure 5:
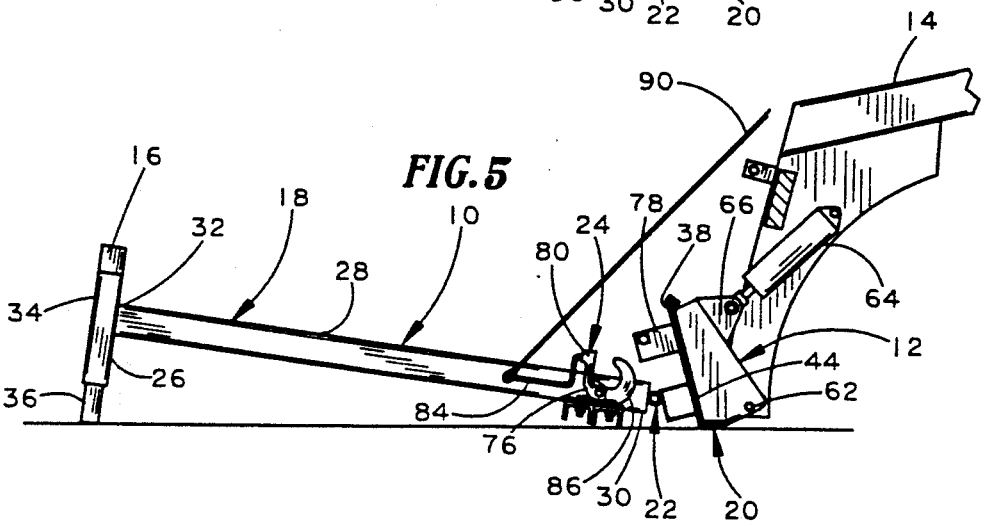
FIG. 5 is an elevational view of the gravity drop hammer apparatus shown in FIG. 4 partially attached to the skid loader.
Figure 6:
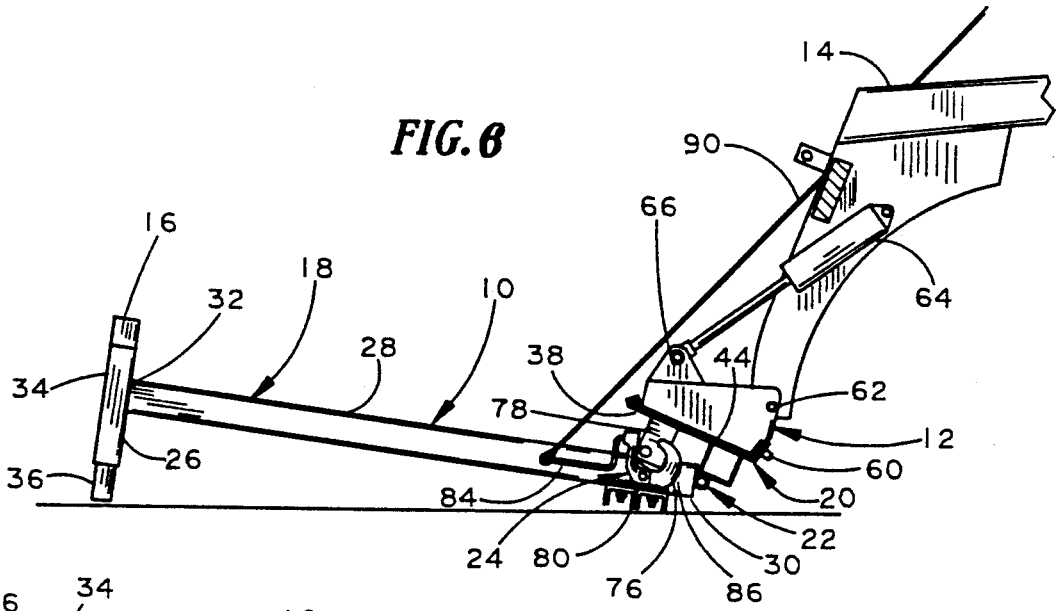
FIG. 6 is an elevational view of the gravity drop hammer apparatus shown in FIG. 5 attached to the skid loader immediately prior to latching and raising of the hammer member.

The face plates 42 and 44 of the bucket attachment means 12 of the skid loader 14 may be pivoted to near horizontal during attachment of the mounting plate member 38 (FIG. 4) and for latching of the hammer member 18 to the mounting plate member 38 (See FIG. 6). The face plates 42 and 44 of the bucket attachment means 12 of the skid loader 14 may be pivoted to near vertical during attachment of the mounting plate member 38 (See FIG. 5) and for raising of the hammer member 18 to a raised position (See FIG. 7). The face plates 42 and 44 are pivoted about a pivot pin 62 by a hydraulic cylinder 64 connected to the interconnected face plates 42 and 44 at bracket 66.

The pivot means 22 between the first end 30 of the arm portion 28 of the hammer member 18 and the mounting plate member 38 are comprised of a pivot pin 68 which passes through a tubular portion 70 of a connecting bracket 72 on the mounting plate member 38 and a corresponding tubular portion 74 at the first end 30 of the arm portion 28 of the hammer member 18. The pivot pin 68 provides an axis about which the hammer member may be pivoted between a raised position and an impact position in a controlled fashion with respect to the mounting plate member 38.

In the preferred embodiment, the releasable latching means 24 include a spring-biased latching hook assembly 76 (spring located internally and not shown) attached near the first end 30 of the arm portion 28 of the hammer member 18 and a latching bracket 78 integrated on the rectangular metal base 40 of the mounting plate member 38. The latching hook assembly 76 and the latching bracket 78 are thus located on opposite sides of the pivot pin 68. The latching hook assembly 76 comprises a stationary member 80 mounted on a mounting shelf 82 and having the spring located therein. The spring is connected on its one end with a lever 84 and on its other end with a jaw 86. The jaw 86 is pivotal with respect to the stationary member 80 about pivot pin 88. The jaw can thus pivot from an open position (See FIG. 6) to a closed position (See FIG. 7). The lever 84 when pulled by a manually operated line 90, in turn, pulls the spring to release the jaw 86 from its closed position to its open position. The latching hook assembly 76 and the latching bracket 78 serve to releasably latch the hammer member 18 and the mounting plate member 38 together.

The gravity drop hammer apparatus 10 is attached to the skid loader 14 and operated in the following manner. The interconnected face plates 42 and 44 of the skid loader 14 are located in an aligned fashion with the mounting plate member 38 of the hammer apparatus 10. The face plates 42 and 44 are pivoted to near horizontal by the hydraulic cylinder 64 (See FIG. 4). The skid loader 14 is then edged forward and the face plates 42 and 44 are pivoted towards vertical catching the overturned lip 46 of the mounting plate member 38 on the way. The pivoting of the face plates 42 and 44 is continued until near vertical at which time the rectangular metal base 40 of the mounting plate member 38 interfaces with the leg portions 43 and 45 of the face plates 42 and 44 and the bottom flanges 48 of the mounting plate member 38 interface with the foot portions 50 and 52 of the face plates 42 and 44 (See FIG. 5). The connecting pins 60 are then placed in the aligned apertures 54 of the bottom flanges 48, and 58 of the foot portions 50 and 52 of the face plates 42 and 44. The mounting plate member 38 and face plates 42 and 44 of the skid loader are now attached and working as an integrated unit so that pivoting of the face plates 42 and 44 by the hydraulic cylinder 64 likewise pivots the mounting plate member 38 of the hammer apparatus 10.

The mounting plate member 38 is then pivoted, by way of the hydraulic cylinder 64 and face plates 42 and 44, downwardly (See FIG. 6) towards horizontal until the latching bracket 78 contacts the open latching hook assembly 76 thereby tripping the latching hook assembly 76 and causing the jaw 86 to pivot from its open position to its closed position. The hammer member 18 and the mounting plate member 38 are now latched and working as an integrated unit so that the pivoting of the mounting plate member 38 by way of the hydraulic cylinder 64 and the face plates 42 and 44 likewise pivots the hammer member 18 of the hammer apparatus 10.

The hydraulic cylinder 64 then pivots the face plates 42 and 44 and the mounting plate member 38 towards vertical, the latched hammer member 18 likewise pivoting upwardly to its raised position (See FIG. 7). The hammer member 18 may be raised to a variety of positions by the hydraulic cylinder 64, depending on the impact desired, since the latching hook assembly 76 is located at the first end 30 of the arm portion 28 of the hammer member 18, opposite the head portion 26 of the hammer member 18.

The operator of the skid loader 14 then pulls on the line 90 which, in turn, pulls the lever 84 thereby expanding the spring to overcome its bias and release the jaw 86 from its closed position to its open position. The open jaw 86 allows the hammer member 18 to drop, under the forces of gravity, from the raised position to the desired impact position, the striking section 36 of the distal portion 16 of the hammer member 18 thus delivering a concentrated blow to the desired impact position. The hammer member 18 may then be relatched and raised again to deliver subsequent blows.

The longitudinally extended arm portion 28 of the preferred hammer member 18 is comprised of a six inch by six inch steel frame which is seven feet long. The preferred head portion 26 of the hammer member 18 weighs 120 pounds and has a four inch by four inch striking section 36. A range of 1 to 180 blows per minute are anticipated. Of course, an unlimited number of alternatives to these dimensions is possible.

One alternative which is contemplated is to provide a telescopic longitudinally extended arm portion of the hammer member which is capable of variable adjustment in length. Another alternative which is anticipated by this invention is to provide head portions of varying dimensions which are interchangeable. Yet another alternative which is contemplated is to provide a rubber boot over the striking section of the head portion of the hammer member to keep rock chips from flying upon impact.

The foregoing description and drawings merely explain and illustrate the invention and the invention is not limited thereto, except insofar as the claims are so limited, as those skilled in the art who have the disclosure before them will be able to make modifications and variations therein without departing from the scope of the invention. By way of example, while the specific latching hook assembly 76 of the preferred embodiment is shown, it is contemplated that other releasable latching assemblies would also work.

What is claimed is:

1. A gravity drop hammer apparatus for mounting on bucket attachment means of a skid loader, in which at least a distal portion of said apparatus is capable of dropping, under forces of gravity, from a raised position toward an impact position, upon release by an operator of said skid loader, said gravity drop hammer apparatus allowing for variable impact at distal locations from said skid loader, said gravity drop hammer apparatus comprising:

(a) a hammer member;

(b) hammer support means for operable attachment to said bucket attachment means of said skid loader, said hammer support means further operably and pivotally attached to said hammer member;

(c) pivot means operably interposed between said hammer member and said hammer support means, said pivot means enabling said hammer member to pivot between said raised position and said impact position; and (d) releasable latching means operably interposed between said hammer member and said hammer support means, said releasable latching means for automatically latching said hammer member to said hammer support means prior to raising said hammer member to said raised position and for maintaining said hammer member in said raised position, said releasable latching means, upon release by said operator of said skid loader, further allowing said hammer member to drop, under forces of gravity, from said raised position towards said impact position.

2. The invention, according to claim 1, in which said hammer member comprises a distal head portion and a longitudinally extended arm portion, said arm portion having a first end and a second end, said first end of said arm portion located proximate and operably and pivotally attached to said hammer support means, said second end of said arm portion located proximate and operably attached to said distal head portion.

3. The invention, according to claim 2, in which said distal head portion comprises a main body section which is operably attached to said second end of said arm portion of said hammer member and a striking section which is operably positioned below said main body section, said striking section which is narrower in cross-section than said main body section.

4. The invention, according to claim 1, in which said hammer support means comprise a mounting plate member corresponding in size and shape for attachment to said bucket attachment means of said skid loader, said mounting plate member having a lip for overlapping a top portion of said bucket attachment means and at least one flange member for underlapping a bottom portion of said bucket attachment means, said flange member and said bottom portion of said bucket attachment means having aligned apertures for insertion of a connecting pin when said hammer support means are attached to said bucket attachment means of said skid loader.

5. The invention, according to claim 1, in which said pivot means operably interposed between said hammer member and said hammer support means comprises a pivot pin penetrating a portion of each of said hammer member and said hammer support means, proximate the region of pivotal attachment therebetween, said pivot pin permitting controlled pivotal rotation of said hammer member relative to said hammer support means.

6. The invention, according to claim 1, in which said releasable latching means comprise a spring-biased latching hook and a latching bracket, one of said latching hook and said latching bracket which is located on said hammer member and one of said latching hook and said latching bracket which is located on said hammer support means, said latching hook and said latching bracket thus being on opposing sides of said pivot means, said latching hook and said latching bracket serving to latch said hammer member and said hammer support means together upon tripping of said latching hook by said latching bracket when said latching bracket is moved into contact with said latching hook prior to raising said hammer member with said hammer support means, said latching hook which closes about said latching bracket after tripping of said latching hook by said latching bracket.

7. The invention, according to claim 6, in which said releasable latching means are released by a manually operated line which is connected to a lever, said lever which is operably attached to said latching hook such that, upon manipulation of said line by said skid loader operator, said lever overcomes said biasing spring thereby opening said latching hook from about said latching bracket allowing said hammer member to drop under forces of gravity from said raised position to said impact position.

* * * * *